United States Patent [19]

Perrin

[11] Patent Number: 4,681,039

[45] Date of Patent: Jul. 21, 1987

[54] DEVICE FOR CONNECTION BETWEEN A TRACTION CABLE AND A BICYCLE WITH AUTOMATIC AND MANUAL DISENGAGEMENT

[76] Inventor: Jean Perrin, 14, Boulevard Henri Ruel, -94120- Fontenay-sous-Bois, France

[21] Appl. No.: 799,792

[22] Filed: Nov. 21, 1985

[30] Foreign Application Priority Data

Nov. 23, 1984 [FR] France ..... 84 17879

[51] Int. Cl.[4] ..... B61B 12/02

[52] U.S. Cl. ..... 104/193; 104/173.2; 24/648; 24/637

[58] Field of Search ..... 24/602, 636, 637, 648; 104/173 ST, 193, 173.2

[56] References Cited

U.S. PATENT DOCUMENTS

| | | | |
|---|---|---|---|
| 1,620,894 | 3/1927 | Jones | 24/648 |
| 3,789,467 | 2/1974 | Aratani et al. | 24/648 |
| 3,837,290 | 9/1974 | Dur | 104/193 |
| 3,942,452 | 3/1976 | Peck | 104/173 St X |
| 4,570,310 | 2/1986 | Gelula | 24/648 X |

FOREIGN PATENT DOCUMENTS

| | | | |
|---|---|---|---|
| 1815531 | 8/1969 | Fed. Rep. of Germany | 104/173.2 |
| 1913373 | 9/1969 | Fed. Rep. of Germany . | |
| 2334308 | 1/1975 | Fed. Rep. of Germany . | |
| 2005456 | 12/1969 | France . | |

*Primary Examiner*—Robert B. Reeves
*Assistant Examiner*—Scott H. Werny
*Attorney, Agent, or Firm*—Sandler & Greenblum

[57] ABSTRACT

A device for connecting a general traction cable and a bicycle, particularly applicable to ski-lifts, for hauling uphill bicycles or like machines, and in particular bicycles used for cross-country or off-the-highway cycling, outside the winter season. The device includes a towing part which is connected to the traction cable via an individual traction cable or individual traction bar. A towed part is connected to the bicycle and a safety device is provided for coupling the two towing and towed parts, with automatic connection by engagement of one of these two parts in the other. This coupling device includes, taking into account the effect of a tension regulator device, a disconnecting device operating on the towed part and releasing the cycle when the rider so desires and possibly in an automatic safety mode. The coupling device also includes an automatic disconnection device operating on the towing part and releasing the cycle when it deviates from the normal path or when it falls on the ground.

22 Claims, 5 Drawing Figures

DEVICE FOR CONNECTION BETWEEN A TRACTION CABLE AND A BICYCLE WITH AUTOMATIC AND MANUAL DISENGAGEMENT

BACKGROUND OF THE INVENTION

The present invention relates to a device for connection between a general traction cable and a bicycle, particularly applicable to ski-lifts, for hauling uphill bicycles or like machines, and in particular bicycles used for cross-country or off-the-highway cycling, outside the winter season.

Cross-country and off-the-highway cycling are sports which are developing at present to a considerable extent, and it is particularly attractive to practice them in mountainous regions, due to the sportive possibilities offered for descents on a cycle and the beauty and variety of the landscape when riding. However, when practicing cross-country cycling on steep ground, it is necessary, after every descent, to climb back up again and this can only be done on foot, pushing the bicycle. Similarly, off-the-highway cycling implies long climbs, which are exhausting for the cyclists. Now, ski-lifts exist in many places, which are generally unused in summer.

It may therefore be envisaged to take advantage of the existence of these ski-lifts, to haul up bicycles during the periods when there is no snow and to enable downhill cross-country cycling to be practiced under the most pleasant conditions possible. However, the traction of bicycles presents two important differences from the traction of the other objects usually hauled by ski-lifts:

- The cyclist is completely independent and he may pass from one ski-lift to another during his rides, and in many cases he is owner of his cycle.
- In the course of traction, the cyclist must steer his machine, taking into account the bumps inflicted thereon by the unequal surface of the slope, and the sudden variations in the efforts of traction that it induces.

The device for connecting a bicycle to the traction cable of the ski-lift must therefore satisfy three conditions. The device should:

- Ensure reliability of the connection despite the bumps and sudden variations in the tractional forces.
- Allow disconnection via that part of the device fixed to the cycle, functioning either on the cyclist's initiative or in an automatic safety mode.
- Ensure automatic safety disconnection via that part of the device joined to the cable of the ski-lift, which alone remains under the permanent control of the ski-lift operator, thus guaranteeing its operational reliability.

None of the existing devices for hauling machines by a ski-lift satisfies these three conditions. More specifically, existing hauling machines:

- either do not offer a sufficient guarantee of a reliable connection when bumps are inflicted on the machine by the rough surface of the track and when there are sudden variations in the tractional forces that this induces, which is the case of the devices described in the Patents DE-A-1 913 373, DE-A-2 334 308 and FR-A-2 005 456;
- or do not allow disconnection via that part of the device fixed to the machine (Pat. Nos. DE-A-2 334 308, FR-A-2 005 456, U.S. Pat. No. 3,942,452);

- or do not allow automatic safety disconnection via that part of the device connected to the cable of the ski-lift (Pat. No. DE-A-1 913 373).

SUMMARY OF THE INVENTION

It is the object of the present invention to ensure the connection of the bicycles to the cable of ski-lifts, satisfying all the conditions set forth hereinabove.

To this end the present invention provides a device for connecting a general traction cable and a bicycle, particularly applicable to ski-lifts, for hauling uphill bicycles or like machines, and in particular bicycles used for cross-country or off-the-highway cycling. The device outside the winter season, comprises a towing part which is connected to the traction cable via an individual traction cable or an individual traction bar, both provided with a tension regulator device, a towed part connected to the bicycle and a safety device for coupling the two towing and towed parts. The safety coupling device automatically engages one of these two parts in the other, this coupling device comprising, taking into account the effect of the tension regulator device, disconnecting means operating on the towed part and releasing the cycle when the rider so desires and also in an automatic safety mode, as well as automatic disconnection means operating on the towing part and releasing the cycle when it deviates from the normal path or when it falls on the ground.

Automatic disconnection of the bicycle is obtained by making use of the fact that, in the two cases mentioned above, the longitudinal vertical plane of the bicycle makes a minimum angle with the axis of the individual traction cable or the individual traction bar.

BRIEF DESCRIPTION OF THE DRAWINGS

The invention will be more readily understood on reading the following description with reference to the accompanying drawings, in which.

DESCRIPTION OF THE PREFERRED EMBODIMENTS

Figure 1:
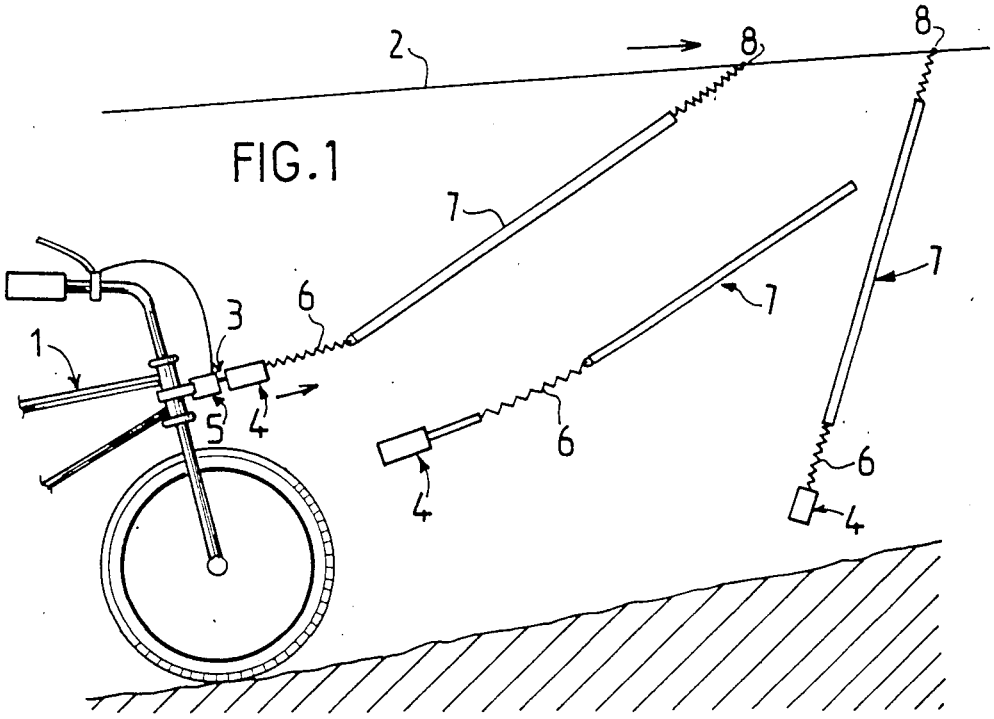
FIG. 1 is a schematic elevational view of a device according to the invention for connecting a traction cable and a bicycle.
Figure 4:
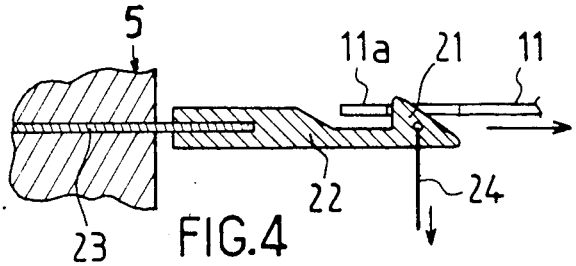
FIG. 4 is vertical cross-sectional a view of an embodiment of the device allowing disconnection via the towed part.

Referring now to the drawings, the device according to the invention is provided to establish a connection between a bicyle 1, for example of the type used for practicing cross-country cycling and cycling for pleasure, and a general traction cable 2 such as that of a ski-lift already installed in a mountainous region, for hauling the cycle 1 and its rider uphill, without the rider having to produce a considerable physical effort.

The connection device comprises a safety device 3 for coupling a towing part 4 connected to the traction cable 2 and a towed part 5 connected to the cycle 1.

The towing part 4 is connected to the traction cable 2 via a tension regulator 6, of the articulated spring type, which is hooked to the lower end of an individual traction cable 7 (or an individual traction bar) which is itself hooked, at its upper end, to the traction cable 2 via a fixing device 8 of any appropriate type.

The safety coupling device 3 allows automatic connection of the two towing and towed parts 4 and 5 respectively, by engagement of one of these female parts in the other male part. Device 3 also permits the disconnection of parts 4 and 5, either manually when the rider arrives at the top of the slope and wishes to release the bicycle, or automatically in the event that the cycle falls or deviates from the axis of traction so as to form too large an angle with the axis of traction.

Figure 3:
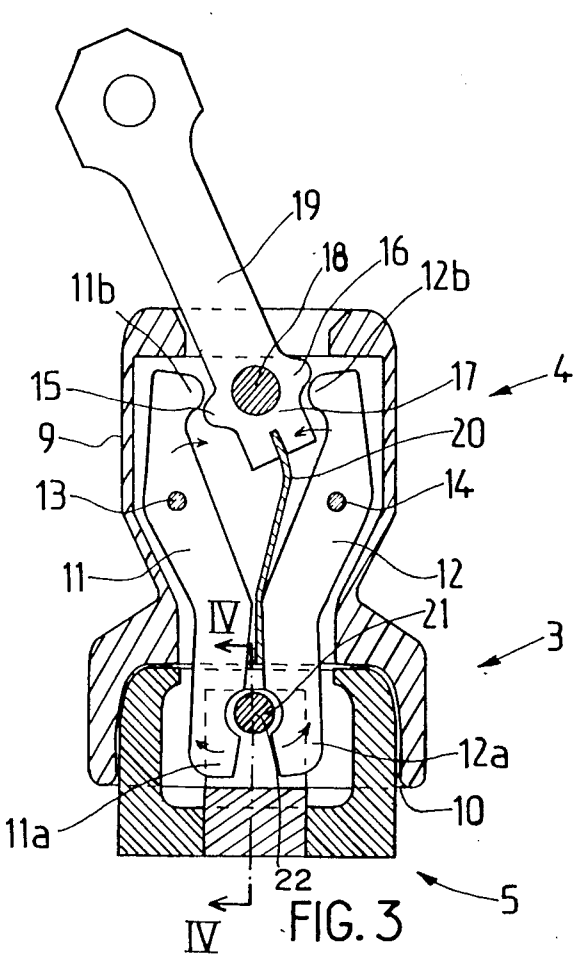
FIG. 3 is a horizontal cross-sectional view of the same device in a position of disconnection by the angle formed by the axis of the individual traction cable or the individual traction bar with the longitudinal vertical plane of the cycle.
Figure 2:
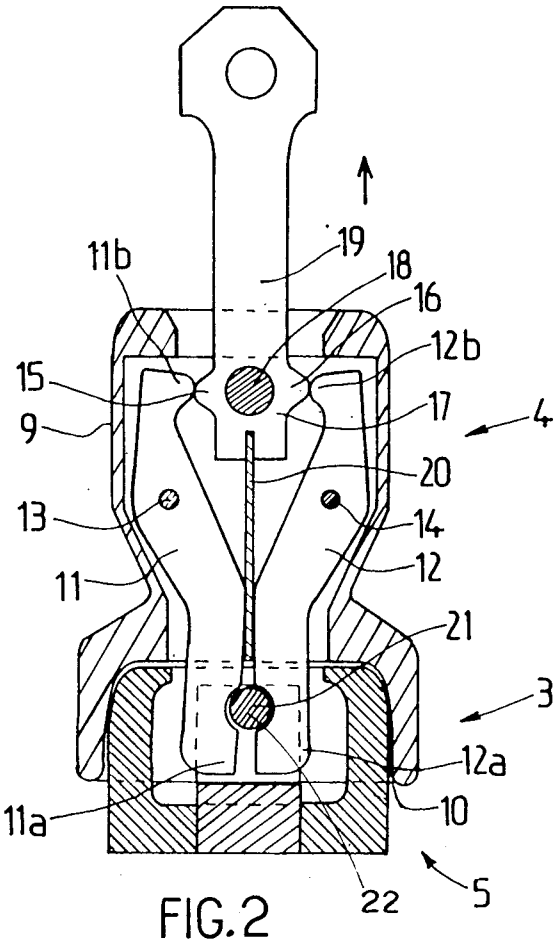
FIG. 2 is a horizontal cross-sectional view of an embodiment of a safety coupling device between the towing part and the towed part, in a coupled position.

A non-limiting embodiment of the safety coupling device is shown in FIGS. 2 and 3.

The towing part 4 comprises a body 9 supporting the traction and safety mechanism, the shape of this body 9 being adapted to receive in its recessed rear part a body 10 of the towed part 5, for avoiding any relative rotation of these two bodies 9, 10 in a position of connection and to facilitating disconnection when the axis of traction forms a minimum angle with the angle of the device.

The traction and safety mechanism of the towing part 4 comprises an assembly of two jaws 11,12, comprising two-armed levers, mounted respectively to pivot, on the body 9 of the towing part 4, about respective pins 13,14 on the body 9. The rear ends 11*a*, 12*a*, of the rear arms of these jaws 11,12, i.e. the ones which are located towards the towed part 5, are normally maintained locked in a position of closure, in the case of axial traction, by lateral locking bosses 15, 16 of a safety cam 17 mounted to pivot, in the front part of the body 9, about a pin 18. The lateral locking bosses 15, 16 of the cam 17 are positioned such that, in the case of axial traction, these two bosses 15,16 lie respectively opposite and in contact with the respective front ends 11*b*, 12*b* of the front arms of the two jaws 11,12. The safety cam 17 is connected to a traction arm 19 which extends forwardly, from cam 17 outside the body 9, and which is connected to the traction cable via the tension regulator device 6 and the individual traction cable or the individual traction bar. Consequently, the cam 17 pivots constantly, in the case of axial traction, about pin 18 in order to follow, exactly, the movements of the axis of traction with respect to the vertical longitudinal plane of the bicycle. In the absence of any axial traction, the safety cam 17 is maintained, by a return spring 20, in a median rest position in which it ensures locking of the two jaws 11 in a position of closure, since its two bosses 15,16 repel the front ends 11*b*, 12*b* of the two jaws 11,12 respectively towards the outside. Thus the rear ends 11*a*, 12*a* of the two jaws 11,12 are clamped towards one another and they maintain therebetween a catch 21 attached to the body 10 of the towed part 5.

In the event that towing part 4 deviates from the axis of traction with respect to the longitudinal vertical plane of the bicycle, rotation of the safety cam 17 in one direction or the other about pin 18 (FIG. 3) provokes retraction of the locking bosses 15,16 so that the front ends 11*b*, 12*b* of the jaws 11,12 are no longer immobilized. Consequently, jaws 11,12 are released and the catch 21 may then escape by itself from the hold of the rear ends 11*a*, 12*a* of the two jaws 11,12. The bicycle is then automatically released.

The catch 21 is advantageously arranged at the front end of a plate 22 which is supported by a spring 23 allowing both downward pivoting of the catch 21, in order voluntarily to release the cycle, and the upward return thereof, for engagement of the towed part 5 in the towing part 4. Manual downward retraction of the catch 21 may be effected by a downward traction on a cable 24 connected to catch 21.

Figure 5:
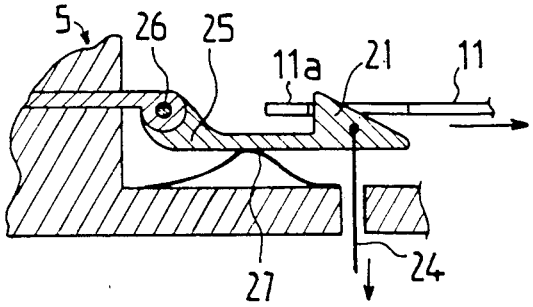
FIG. 5 is vertical cross-sectional a view of an alternative embodiment of the device allowing disconnection via the towed part.

In the alternative embodiment illustrated in FIG. 5, the catch 21 is fast with an arm 25 mounted to pivot about a horizontal, transverse pin 26 and pushed upwardly by a spring 27. In this embodiment again, a traction cable 24 hooked to the catch 21 makes it possible to pivot the latter downwardly, against the force exerted by the spring 27, in order to release the towed part 5 from the towing part 4.

I claim:

1. An apparatus for connecting a traction cable to a vehicle, wherein said traction cable is adapted to properly pull said vehicle along a normal path with respect to said cable, said apparatus comprising:

(a) a towing device connected to said traction cable;

(b) a towed device connected to said vehicle; and (c) a safety device for coupling said towing and towed devices and comprising:

means for manually disconnecting said towed and towing devices; and means for automatically disconnecting said towed and towing devices in response to at least one of the following conditions: deviation of said vehicle from said normal path, and falling of said vehicle to the ground.

2. The apparatus defined by claim 1 wherein said device further comprises means for connecting cross-country bicycles adapted for off-the-highway cycling to the traction cable of a ski lift so as to haul said bicycles uphill outside of the winter season.

3. The apparatus defined by claim 2 wherein said ski lift further comprises at least one individual cable attached to said traction cable and a tension regulating device, connected to said individual traction cable wherein said towing device is adapted to be connected to said individual cable.

4. The apparatus defined by claim 2 wherein said ski lift further comprises: at least one individual traction bar connected to said traction cable; and a tension regulating device connected to said traction bar, wherein said towing device is adapted for connection to said traction bar.

5. The apparatus defined by claim 2 wherein said towing and towed devices comprise means for engaging a portion of one of said towing and towed devices into a portion of the other of said towed and towing devices.

6. The apparatus defined by claim 5 wherein said ski lift further comprises a tension regulating device attached to said traction cable and said apparatus, wherein said safety device further comprises means for disconnecting said towed and towing devices as a function of the operation of said tension regulating device.

7. The apparatus defined by claim 6 wherein both of said disconnecting means comprise means for releasing said towing device from said traction cable.

8. The apparatus defined by claim 7 wherein said two disconnecting means comprise means for operating independently of one another.

9. The apparatus defined by claim 4 further comprising means for biasing said safety device against disconnecting said towing device from said traction cable.

10. The apparatus defined by claim 7 wherein said towed device comprises a body, wherein said towing device comprises a body for supporting said safety device and receiving said body of said towed device, wherein said body of said towing device comprises means for preventing the relative rotation of said bodies of said towing and towed devices when said two bodies engage each other.

11. The apparatus defined by claim 10 where said towed device comprises a catch, wherein both of said disconnecting means comprise:

two jaws adapted to pivot on said body of said towing device, wherein the rear ends of said jaws are adapted to engage and disengage a portion of said towed device in response to pivoting of said jaws; and means for biasing a cam of said cable to maintain said jaws into a closed position in which the rear ends of said jaws engage said catch of said towed device, in the absence of a traction force on said cam;

wherein the front ends of said jaws comprise means for engaging said cam attached to said traction cable so that said jaws are locked in said closed position in response to axial traction from said cam.

12. The apparatus defined by claim 11 wherein said biasing means comprises a return spring attached to said body of said towing device, wherein said body of said towing part further comprises a plurality of pins pivotally mounting said jaws on said body of said towing device, wherein said body of said towing device further comprises means for housing said cam, and a pin for pivotally mounting said cam in said body of said towing device.

13. The apparatus defined by claim 12 wherein said catch is adapted to be displaced downwardly to release said catch from said jaws, and upwardly into engagement with said jaws, wherein said catch further conmprises a spring for displacing said catch upwardly to return said catch into engagement with said jaws after downward displacement to release said catch from said jaws, wherein said manual disconnecting means comprises a release cable for exerting a downward traction on said catch to release said catch from said jaws, thereby separating said towing and towed devices.

14. The apparatus defined by claim 1 wherein both of said disconnecting means comprise a pair of jaws adapted to be pivotally mounted on said towing device, wherein the rear end of said jaws are adapted to engage and disengage said towed device in closed and open positions, respectively of said jaws, in response to pivoting of said jaws, wherein the front end of said jaws are adapted to engage a cam connected to said traction cable, wherein said jaws comprise means for opening said rear end of said jaws in response to displacement of said cam with respect to said front of said jaws.

15. The apparatus defined by claim 14 wherein said towing device further comprises means for pivotally mounting said cam on said towing device, wherein said jaws comprise means for opening the rear end of said jaws in response to relative pivoting between said cam and said towing device.

16. The apparatus defined by claim 15 wherein said jaws comprise means for remaining closed in response to positioning of said cam with respect to said towing device so that said cam is aligned with the longitudinal vertical plane of said vehicle.

17. The apparatus defined by claim 16 wherein said jaws further comprise means for opening in response to pivoting of said cam out of alignment with the longitudinal vertical plane of said vehicle.

18. The apparatus defined by claim 17 further comprising means for biasing said cam into said aligned position.

19. The apparatus defined by claim 17 in combination with said cam, wherein said cam comprises two lateral locking bosses, wherein said front end of said jaws are adapted to be spaced apart by a first distance in a first position in which the rear ends of said jaws engage said towed device, and said jaws are adaped to be spaced apart by a second distance in a second position in which said front end of said jaws are closer together than in said first position and in which said rear ends of said jaws are disengaged fronm said towed device, wherein said first distance is substantially equal to the width of said cam measured through said lateral locking bosses, wherein said first distance is greater than the width of said cam through a portion of said cam spaced from said lateral locking bosses.

20. An apparatus for connecting a traction device to a vehicle comprising:

(a) a towing device connected to said traction device;

(b) a towed device connected to said vehicle; and (c) a safety device for coupling and uncoupling said towing and towed devices and comprising a pair of jaws pivotally mounted on said towing device, wherein said pair of jaws comprise front and rear ends, wherein said rear ends comprise means for engaging and disengaging from said towed device so as to connect and disconnect said towed and towing devices in response to pivoting of said jaws, wherein said front ends comprise means for engaging a cam connected to said traction device and for pivoting said jaws in response to relative pivotal movement between said cam and said towing device.

21. The apparatus defined by claim 20 further comprising means for pivotally connecting said cam to said towing device.

22. The apparatus defined by claim 21 wherein said jaws comprise: means for engaging the rear ends of said jaws with said towed device in response to alignment of said cam with the longitudinal vertical plane of said vehicle; and means for disengaging the rear ends of said jaws from said towed part in response to pivoting of said cam beyond a predetermined extent out of alignment with the longitudinal vertical plane of the vehicle.

* * * * *